United States Patent [19]

Myers

[11] 4,274,392

[45] Jun. 23, 1981

[54] CONTROLLED AIR INTAKE APPARATUS FOR FURNACES AND THE LIKE

[76] Inventor: Delbert L. Myers, 3229 W. 32nd St., Anderson, Ind. 46011

[21] Appl. No.: 76,341

[22] Filed: Sep. 17, 1979

[51] Int. Cl.[3] ..... F24H 3/00; G05D 23/00

[52] U.S. Cl. ..... 126/112; 110/147; 126/77; 126/285 B; 126/290; 236/16

[58] Field of Search ..... 236/1 G, 11, 16; 431/20; 126/112, 15 R, 15 A, 77, 146, 193, 290, 285 R, 285 A, 285 B; 110/147, 175 R, 175 A, 182

[56] References Cited

U.S. PATENT DOCUMENTS

| | | | |
|---|---|---|---|
| 1,794,530 | 3/1931 | Newell | 236/16 |
| 2,256,840 | 9/1941 | Haines | 236/16 |
| 2,393,855 | 1/1946 | Cheasley | 126/77 |
| 2,767,905 | 10/1956 | Creed | 126/15 A |
| 2,937,697 | 5/1960 | Johnston | 158/28 |
| 3,951,051 | 4/1976 | Dry | 126/285 B |
| 3,999,710 | 12/1976 | Kemmerer | 126/285 R |
| 4,021,187 | 5/1977 | Schulte et al. | 126/285 B |
| 4,155,699 | 5/1979 | Hansen | 126/285 B |
| 4,184,474 | 1/1980 | Pulliam et al. | 126/146 |
| 4,201,185 | 5/1980 | Black | 126/15 R |
| 4,204,833 | 5/1980 | Kmetz et al. | 236/1 G |

*Primary Examiner*—Daniel J. O'Connor

[57] ABSTRACT

A controlled air intake apparatus for a furnace includes a substantially flat cover plate attached to and placed over the updraft opening of the flue and a generally rectangular housing attached over the air intake opening adjacent the burner region. The housing includes a first open side and opposite thereto a side including a plurality of apertures. The remaining sides of the housing are enclosed. The first plurality of apertures are disposed into two rows and the housing further includes a cover plate with a similar arrangement of apertures. The cover plate is slidably received by the housing and is movable by means of a solenoid between an aperture-closed orientation and an aperture-open orientation. The solenoid responds to the thermostat which also controls the furnace energizing and deenergizing such that when the furnace is turned on the cover plate is moved to a position wherein the first plurality of apertures are in alignment with the second plurality of apertures enabling the introduction of combustion air into the furnace. When the furnace is deenergized, the solenoid is also deenergized and a spring return feature brings the cover plate back into an orientation wherein the plate covers the apertures in the housing.

10 Claims, 6 Drawing Figures

CONTROLLED AIR INTAKE APPARATUS FOR FURNACES AND THE LIKE

BACKGROUND OF THE INVENTION

This invention relates in general to means and apparatus for controlling the air introduction into furnaces and in particular into gas furnaces which typically have a plurality of evenly spaced burners.

The design of heating units, such as gas furnaces, involves considerations of fuel efficiency, and operational economy. One objective is to obtain the maximum amount of heat from a volume of fuel and to efficiently conduct that heat to areas of the residence or building which are below the desired temperature. As the fuel is burned, heat is generated by the combustion process and by heat exchange means. This generated heat of combustion is transferred to clean heating air which then circulates through the building. The combustion gases and unburned particles of fuel exit from the furnace and from the building by means of an exhaust flue. The air for combustion enters by way of an open area in the lower region of the furnace adjacent the burner location. Typically, there are no restrictions on this open area and the incoming air establishes an entering velocity based upon pressure differentials created by the rising hot air from within. The flue typically includes an updraft opening at its lowermost end which enhances the "chimney effect" of the flue and allows a higher upward air velocity. This upward air flow increases the evacuation of exhaust fumes and unburned fuel particules from within the combustion chamber of the furnace.

While this foregoing description represents the typical gas furnace arrangement, a number of subtleties exist which may greatly influence fuel economy and overall operational efficiency. One factor involves the aspect of allowing the flue updraft opening to remain open at all times. When this is done any heat retained within the furnace after the furnace is turned off will exit more rapidly due to the updraft created. As this retained heat exits, the overall furnace temperature drops and when the furnace is restarted, a portion of the initial heat generated will be absorbed by the furnace itself rather than being directed to heating of the building. By providing some means to retain heat within the furnace longer, the heat generated by the fuel which is burned will be utilized more efficiently.

Another factor involves the introduction of the air into the burner area of the furnace. There are typically three or four burner locations which are somewhat evenly spaced apart and as air enters, this air is utilized for combustion in the immediate vicinity of the burners. However, a portion of the entering air which does not pass in close proximity to the burners will not be utilized for combustion and will travel somewhat directly through the combustion chamber and up the flue. This increased means flow rate of air which passes in and out through the furnace and is not utilized in any constructive way has a tendency to draw with it certain heated air. This heated air loss occurs before any effective heat transfer can be achieved and thus lowers the overall furnace efficiency. By controlling the amount of air which is introduced into the furnace such that the amount of air corresponds more optimally to just that amount needed for complete combustion, the flow of air through the furnace is reduced and the heat generated within the furnace is retained longer.

Another factor or consideration which finds a certain applicability to the present invention is that any medium which is being burned is burned more efficiently and more completely if the fuel is mixed more thoroughly with the combustion air. In order to enhance such mixing, a certain degree of air turbulence is desired as the air contacts the gas. With a single open area for air introduction into the burner region of the furnace, such air turbulence is not generated to a sufficient degree and consequently, this desirable mixing does not take place to an optimal degree. By the incorporation of a plurality of apertures or air inlet orifices, the turbulence of the incoming air can be increased and this in turn will create a mixing action of both the air and the gas thereby contributing to a more complete combustion and improved fuel utilization.

The following list of patents represent certain furnace controls and systems which have been conceived for a variety of purposes, yet none of the listed references provide the various means or structure to achieve those improvements which have been mentioned.

| Patent No. | Patentee |
|---|---|
| 4,155,699 | Hansen |
| 2,937,697 | Johnston |
| 4,021,187 | Schulte et al. |
| 3,999,710 | Kemmerer |
| 3,951,051 | Dry |

Hansen discloses a gas furnace concept which includes means for automatically closing the air inlet to the combustion chamber as well as the air inlet to the diverter air opening at the flue immediately after cessation of the main burner flame and also for opening both of the air inlets immediately prior to the ignition of the main burners.

Johnston discloses a furnace draft control which includes a parallel connection of two solenoids, one of which acts on an air inlet damper to the combustion chamber and the other of which acts on a similar damper arrangement associated with the flue. This arrangement, which is similar to Hansen, also results in simultaneous opening or closing of the two inlet locations.

Schulte et al. discloses a flue gate device which is operated by a solenoid whose energy comes from an outside source and this energy is controlled by the furnace burner control. The solenoid is deenergized when the furnace burner is energized and the solenoid is energized when the burner is deenergized thus enabling a fail-safe condition which enables the furnace to function completely free of the flue gate device.

Kemmerer discloses an auxiliary heating arrangement for a building which includes a solenoid-controlled damper subassembly.

Dry discloses a damper design which is operable by energizing or deenergizing an electrical circuit to open or close the damper for control of smoke ventilation in case of a fire.

These five references do not disclose permanently closing the updraft opening of the flue, a plurality of air inlet apertures adjacent the burner area of the furnace nor means to selectively open and close these apertures; all of which constitute improvements embodied within the present invention and which contribute to greater fuel efficiency and furnace economy. These advantages as well as others will be apparent from the descriptions which follow.

SUMMARY OF THE INVENTION

A controlled air intake apparatus for a furnace of the type which includes a burner air intake opening and a flue updraft opening according to one embodiment of the present invention comprises a first closure member disposed over the updraft opening of the flue and a second closure member disposed over the burner air intake opening, said second closure member including a first plurality of apertures for introducing air and a cover plate disposed over the plurality of apertures, the cover plate being arranged to selectively open and close the plurality of apertures.

One object of the present invention is to provide improved air intake means for gas furnaces.

Related objects and advantages will be apparent from the following description.

DESCRIPTION OF THE PREFERRED EMBODIMENT

Figure 4:
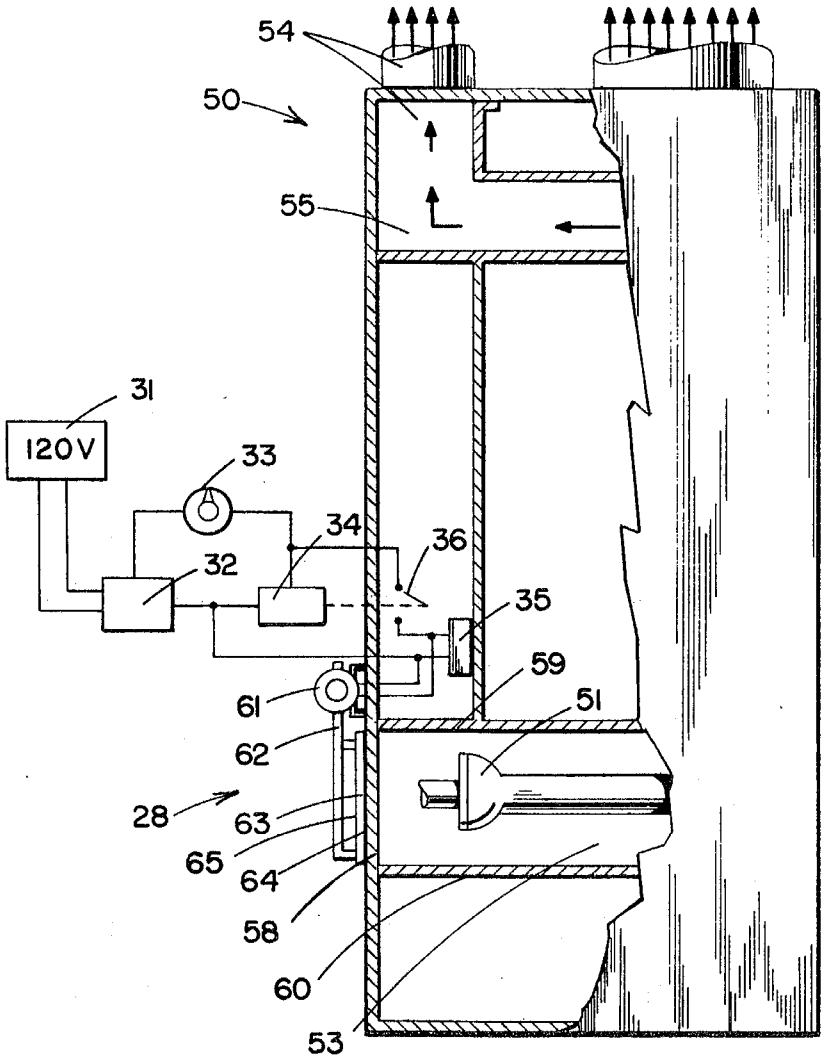
FIG. 4 is a diagrammatic side elevation view of a furnace incorporating controlled air intake means according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
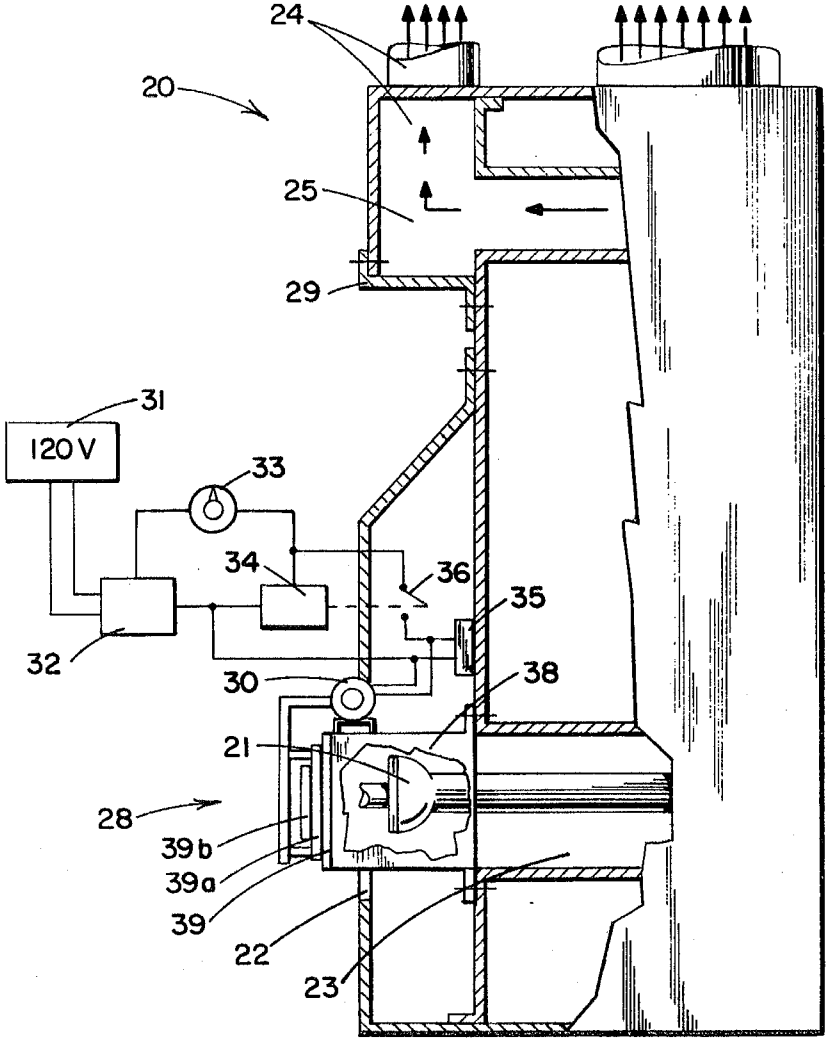
FIG. 1 is a diagrammatic side elevation view of a furnace in combination with a controlled air intake apparatus according to a typical embodiment of the present invention.

Referring to FIG. 1, there is diagrammatically illustrated a gas furnace 20 which includes a series of burners 21, a burner air intake opening 22, a combustion chamber 23, an exhaust flue 24 and a flue updraft opening 25. Also diagrammatically illustrated is a controlled air intake apparatus which includes enclosure 28 and closure member 29. Enclosure 28 includes therewith a solenoid 30 which is operable in response to normal furnace operation, as is further diagrammatically illustrated by the related circuitry.

Although a variety of circuitry may be employed, depending upon the various options, safety features and furnace design, a typical representation includes a suitable source of power 31, such as that from a conventional house outlet, a transformer 32, a thermostat 33, a relay 34, a fuel control valve 35 and a relay-controlled switch 36. Transformer 32 steps down the incoming power and across one line connects to relay 34, fuel control valve 35 and solenoid 30. The other output line from transformer 32 couples to thermostat 33 and the output side of thermostat 33 couples to relay 34 and switch 36. When the thermostat 33 senses a room temperature below the desired level, the thermostat effectively closes thereby completing the circuit from transformer 32 to relay 34 and the activation of relay 34 closes switch 36 to complete the circuit to both fuel control valve 35 and solenoid 30. Consequently, the thermostat controls the energizing of the furnace and when the furnace is energized, so is the solenoid.

Figure 2:
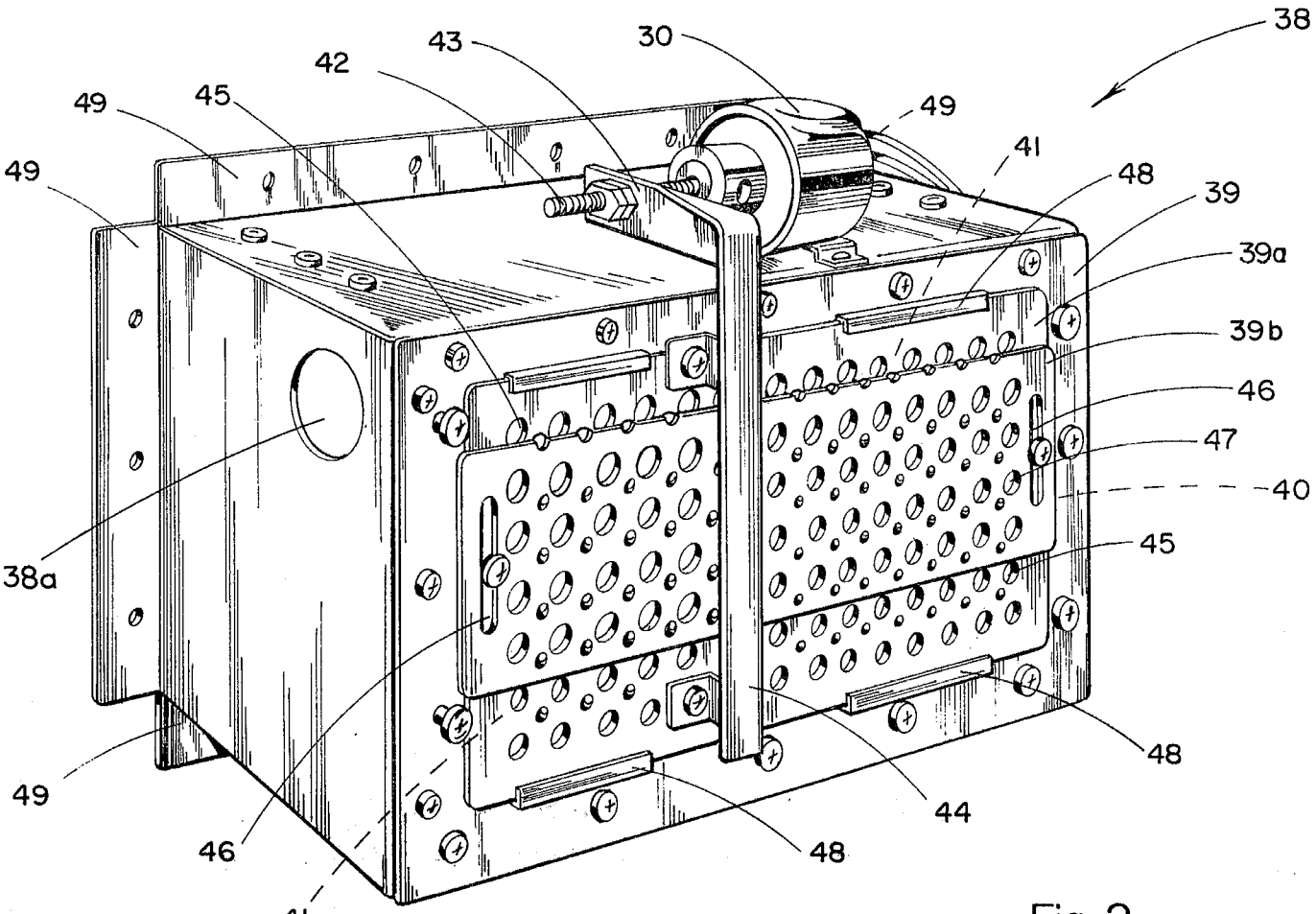
FIG. 2 is a perspective view of an air intake enclosure comprising a portion of the FIG. 1 controlled air intake apparatus.

Closure member 29 includes a substantially flat plate with turned edges and means for attaching this plate to updraft opening 25. Although the size, shape and general construction of closure member 29 will depend upon the size, shape and construction of updraft opening 25, it is to be understood that the function of closure member 29 is to completely close off opening 25 so that air cannot be introduced. It is not required that the fit of member 29 over opening 25 be air tight, but should be snug and consequently, a sheet-metal-to-sheet-metal fit is acceptable. Conventional fasteners such as sheet metal screws may be used to securely hold closure member 29 over flue opening 25. The other main component of the controlled air intake apparatus according to the present invention is enclosure 28 which includes a substantially rectangular box-like housing 38, solenoid 30 and cover plates 39, **39*a* and 39*b*. The length, height and width dimensions of housing 38 are suitably sized such that housing 38 is able to fit within air intake opening 22 and around burners 21. Any air which enters combustion chamber 23 must pass through housing 38 rather than around housing 38 and such air must then flow across the burners. The side of housing 38 facing furnace 20 is completely open as is the opposite side 40. Cover plate 39 completely covers opposite side 40 and includes a plurality of apertures 41, each of which are hidden from view in the FIG. 2 illustration. Cover plate 39 is attached to the edges of side 40 by conventional fasteners such as sheet metal screws, and may be easily removed to gain access to the interior of the furnace. The remaining sides of housing 38 are solid, continuous and free of any openings, except for circular apertures 38*a* which are provided at each end for clearance of the pipe which extends from one side of the furnace to the other side. Apertures 41 are arranged into a series of aligned rows and columns and the apertures are evenly spaced apart in a repeating pattern. Similarly, cover plates 39*a* and 39*b* have the same aperture pattern as plate 39 but plates 39*a* and 39*b* are smaller in overall size than plate 39**.

Arm 42 of solenoid 30 (see FIG. 2) is directly attached to the upper portion of cover plate arm 43. The lower portion 44 of the cover plate arm 43 is attached directly to cover plate **39*a*. Cover plate 39*a* also includes a second plurality of apertures 45 which are equal in number, arrangement and spacing to apertures 41 in cover plate 39. With cover plate 39 in the illustrated position of FIG. 2, enclosure 28 is in a closed position and in this position, apertures 45 are staggered from apertures 41 by a dimension "d." With the aperture patterns of plates 39 and 39*a* completely out of registration in this closed position, combustion air is unable to pass through the apertures of plate 39 and enter the combustion chamber. Also in this particular orientation, solenoid 30** is in a deenergized mode and there is a spring return as part of the solenoid which results in arm 42 being disposed in a normally retracted position. Cover plate 39 is slidably received by runners 48 which are attached to cover plate 39 and which overlap a portion of the edge periphery of cover plate 39*a*.

Cover plate 39*b* provides a type of selective air volume adjustment. Plate 39*b* includes two vertically extending slot-like apertures 46 which slide relative to screws which are received by cover plate 39*a*. Since cover plate 39*b* has an aperture pattern substantially the same as plates 39 and 39*a*, vertical travel enables partial closure of some of the apertures and thus a reduction in the air inlet area. In the illustrated embodiment, the apertures 47 of plate 39*b* are aligned with apertures 45.

Figure 3B:
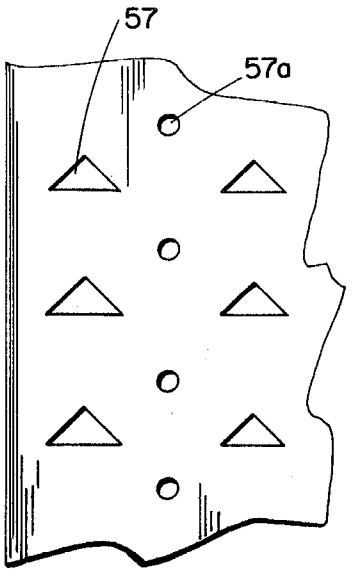
FIGS. 3A and 3B are partial diagrammatic front elevation views of alternative aperture patterns for the FIG. 2 air intake enclosure.
Figure 3A:
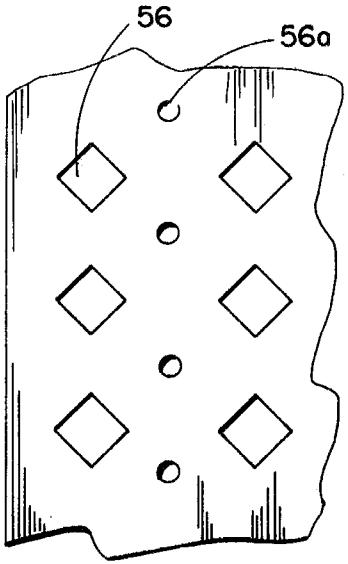

Upon energizing solenoid 30, arm 42 moves outwardly to an extended position a distance substantially equal to dimension "d" and through the action of cover plate arm 43 and the sliding movement of cover plate 39*a*, apertures 45 are brought into registration (alignment) with apertures 41 thereby allowing an inlet flow of air through each aligned pair of apertures. Various streams of combustion air are focused toward each burner and by selectively choosing an appropriate size of aperture for the particular furnace, a moderate level of air turbulence is created which enhances the mixing of the air with the gas for more complete combustion. Recognizing that air turbulence is an advantage, it is also envisioned that what appear as generally circular openings (apertures 41, 45 and 47) can be modified into a variety of shapes (see FIGS. 3A and 3B) such as diamond, triangular, square, etc. Diamond-shaped apertures 56 combined with smaller circular apertures 56*a* are illustrated in FIG. 3A and triangular-shaped apertures 57 with smaller circular apertures 57*a* are illustrated in FIG. 3B. The size of the apertures can also be varied which will have some effect on velocity, and to further enhance the air turbulence smaller staggered apertures 41*a*, 45*a* and 47*a* are provided. It is also envisioned that in lieu of apertures 41 in cover plate 39, that generally rectangular openings could be provided while still retaining apertures 45 in cover plate 39*a*. It is further envisioned that apertures 45 could be sized somewhat less than apertures 41 and thereby allow a certain versatility to enclosure 28 by exchanging one cover plate design for a different cover plate design and allowing the remainder of the enclosure 28 to be unchanged.

Figure 3:
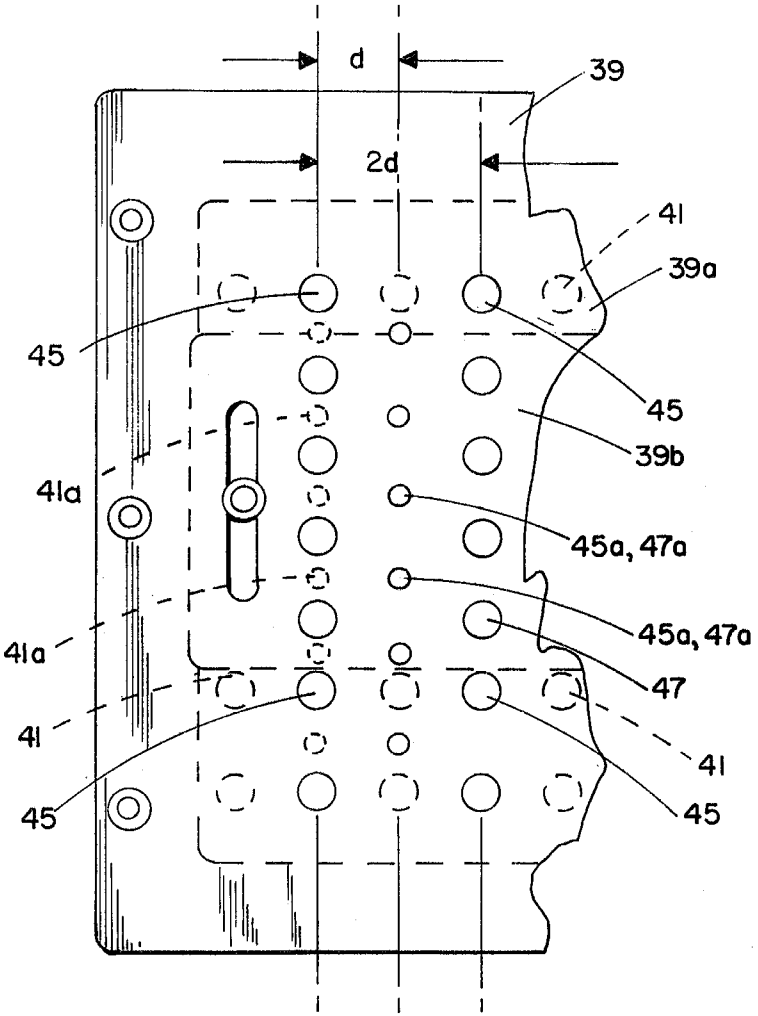
FIG. 3 is a partial, diagrammatic front elevation view of the FIG. 2 air intake enclosure.

FIG. 3 diagrammatically represents the aligned and overlapping aperture arrangements of cover plates 39, 39*a* and 39*b*. As illustrated, apertures 41 are covered by the solid areas of plate 39*a* and are spaced apart from each other by a dimension "2*d*." Apertures 45 are evenly spaced therebetween such that cover plate 39*a* is movable to an air-inlet-open position relative to plate 39 by travel of the solenoid arm a distance equal to "d." Apertures 45 and 47 are aligned in the illustrated closed position as are apertures 45*a* and 47*a*, and corresponding apertures 41 and 41*a* are uniformly staggered. The vertical spacing of each aperture arrangement is the same.

Although it is desirable for solenoid 30 to be operable directly from the furnace circuit, which includes the thermostat and the fuel control valve, other hydraulic and pneumatic means may be utilized for the movement of cover plate 39*a*. In the event the present invention is adapted for use in industrial settings rather than merely residential circumstances, air pressure lines may be available and consequently these could be incorporated into the system by replacing solenoid 30 with a double-acting air cylinder. The same principles with respect to the FIG. 1 circuitry could nevertheless still be utilized by providing an air valve for controlling the energizing or deenergizing of the cylinder. Although an air or hydraulic cylinder would typically be a double-action device, solenoid 30 incorporates a spring return arrangement in order to recall cover plate 39*a* from an open position back to its normally closed position. One advantage with enclosure 28 is its adaptability to conventional furnaces and in order to attach enclosure 28 around the air intake opening of the furnace, flanges such as 49 are provided along the edges of the open side of housing 38 with which sheet metal screws may be utilized for attachment of housing 38 to interior surfaces of furnace 20.

While the structural arrangement of enclosure 28 represents an after-market potential, it is also envisioned to incorporate the principles of the present invention into the particular gas furnace at the factory location prior to shipment to a distributor or other customer. In the event controlled air intake means are incorporated as part of the gas furnace, certain ones of the structural requirements of enclosure 28 may be eliminated. FIG. 4 represents one possible built-in arrangement for controlled air intake. Referring to FIG. 4, gas furnace 50 includes a series of burners 51, air intake opening 52, combustion chamber 53, exhaust flue 54 and the previous flue updraft opening 55 which is now permanently closed. Disposed over combustion chamber 53 is a cover plate 58 which attaches to the top surface 59 of furnace 50 and extends downwardly to join with bottom surface 60. Attached above mounting plate 58 and to the exterior of the furnace is a solenoid 61 or similarly a hydraulic or pneumatic cylinder and coupled to the arm of this solenoid is a cover plate arm 62 which attaches directly to cover plate 63 which is disposed over a portion of mounting plate 58. This lower portion of mounting plate 58 includes a plurality of apertures 64 and cover plate 63 includes a similar plurality of apertures 65 which are sized and arranged similar to aperture 64. This arrangement may also include yet a third plate for vertical movement relative to plate 63 for varying the air inlet area. The operation of the controlled air intake means illustrated by FIG. 4 is similar to that illustrated in FIGS. 1 and 2 wherein the solenoid action moves the cover plate laterally across the innermost set of apertures until the cover plate apertures 65 are placed in registration or at least partial registration with apertures 64 to allow the entry of combustion air. The various alternative arrangements and aperture shapes and number variations previously described are equally applicable in this embodiment as has been previously discussed with the embodiment of FIGS. 1 and 2.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A controlled air intake apparatus for a furnace of the type which includes a burner air inlet opening, a combustion zone, a flue and a flue updraft opening, said controlled air intake apparatus comprising:

a first closure member disposed over the updraft opening of the flue said closure member comprising a fixed plate means for completely closing said flue updraft opening under all operating conditions;

a second closure member disposed over the burner air inlet opening, said second closure member including a first plurality of apertures arranged into a first pattern and adapted for introducing air into said combustion zone via said burner air inlet opening; and a movable cover plate disposed relative to said second closure member, said movable cover plate defining a plurality of openings arranged into a second pattern and further, said movable cover plate being movable between a first position wherein said second pattern of openings is in registration with said first pattern of apertures and a second position wherein said first and second patterns are completely out of registration with each other such that air flow into said combustion zone via first plurality of apertures is prevented.

2. The controlled air intake apparatus of claim 1 wherein said first closure member includes a closure plate which is free of any apertures and is of a suitable size and shape to completely close said flue updraft opening.

3. The controlled air intake apparatus of claim 2 wherein said second closure member further includes a housing open on one side and provided with said first plurality of apertures on the side opposite said one side.

4. The controlled air intake apparatus of claim 3 which further includes a solenoid cooperatively attached between said second closure member and said movable cover plate and adapted for movement of said cover plate between said first and second positions.

5. The controlled air intake apparatus of claim 1 which further includes a second cover plate slidably attached to said movable cover plate and movable therewith, said second cover plate having a plurality of apertures arranged into a third pattern, the spacing and arrangement of said plurality of openings corresponding to the spacing and arrangement of the plurality of apertures in said second cover plate.

6. The controlled air intake apparatus of claim 1 wherein said first plurality of apertures and said plurality of openings are each arranged into at least three rows with a plurality of apertures and a plurality of openings, respectively, in each row.

7. The controlled air intake apparatus of claim 1 which further includes an arm automatically movable between an extended position and a retracted position and connected to said movable cover plate for movement of said cover plate between said first and second positions, the movement of said arm being controlled by the energizing and deenergizing of said furnace.

8. The controlled air intake apparatus of claim 1 which further includes means for moving said movable cover plate between air intake orientation wherein said apertures of said first plurality permit the passage of air into said combustion zone and a closed orientation wherein said first plurality of apertures are closed by said movable cover plate.

9. The controlled air intake apparatus of claim 8 wherein said moving means includes a solenoid attached to said second closure member and connected to said movable cover plate.

10. The controlled air intake apparatus of claim 9 wherein said solenoid is automatically operable in response to a thermostat signal.

* * * * *